US008425337B2

(12) United States Patent
Thompson

(10) Patent No.: US 8,425,337 B2
(45) Date of Patent: Apr. 23, 2013

(54) PVC SHELL SKATEPARK

(76) Inventor: Dean Ronald Thompson, Kowloon (HK)

( * ) Notice: Subject to any disclaimer, the term of this patent is extended or adjusted under 35 U.S.C. 154(b) by 331 days.

(21) Appl. No.: 12/857,744

(22) Filed: Aug. 17, 2010

(65) Prior Publication Data

US 2012/0021844 A1 Jan. 26, 2012

Related U.S. Application Data

(63) Continuation-in-part of application No. 12/842,404, filed on Jul. 23, 2010.

(51) Int. Cl.
*A63C 17/16* (2006.01)
*E04H 3/14* (2006.01)
*A63H 33/00* (2006.01)

(52) U.S. Cl.
USPC ..... 472/89; 472/136; 428/159; 14/69.5; 14/71.1; 14/78; 446/168; 446/429; 446/476; 446/489; 446/491; D21/817

(58) Field of Classification Search ..... None
See application file for complete search history.

(56) References Cited

U.S. PATENT DOCUMENTS

| | | | | |
|---|---|---|---|---|
| 3,549,441 | A * | 12/1970 | Mesinger et al. | 156/79 |
| 3,976,526 | A * | 8/1976 | Hovey et al. | 156/212 |
| 4,454,188 | A * | 6/1984 | Penta et al. | 428/172 |
| 5,326,267 | A * | 7/1994 | Brokaw | 434/151 |
| 5,805,677 | A * | 9/1998 | Ferry et al. | 379/93.35 |
| 6,623,367 | B1 * | 9/2003 | Labelson et al. | 472/89 |
| 7,261,613 | B1 * | 8/2007 | Hull | 446/444 |
| 2007/0082171 | A1 * | 4/2007 | Fulton | 428/87 |

* cited by examiner

*Primary Examiner* — David Sample
*Assistant Examiner* — Nicole T Gugliotta
(74) *Attorney, Agent, or Firm* — Clement Cheng

(57) ABSTRACT

A skate park has a hard top shell formed with skate features drawn down from a top surface of the hardtop shell. The hard top shell has a thickness between 0.2 mm and 1 mm. The hard top shell has a hard top shell inside surface. The hard top shell is pervious to light. A sidewall is formed on a side of the hardtop shell. A paint layer is disposed on the hard top shell inside surface. The skate park may have at least one half pipe. A foil layer may be laminated to the underside of the hardtop shell. The skate park preferably includes at least one bowl recess, but may have two bowl recesses joined at a connecting ridge.

6 Claims, 4 Drawing Sheets

PVC SHELL SKATEPARK

This application claims priority and is a continuation in part from inventor THOMPSON, Dean United States utility patent application Ser. No. 12/842,404 entitled Hard Shell Bodyboard Kickboard, filed Jul. 23, 2010, the disclosure of which is incorporated herein by reference.

FIELD OF THE INVENTION

The present invention is in the field of skateparks.

DISCUSSION OF RELATED ART

A fingerboard is a miniature toy version of a skateboard, but instead of skating with one's legs, one's fingers are used to skate. It is not only similar to the skateboard in its looks, but the tricks performed with a fingerboard are very similar to skateboarding tricks. For example, an 'ollie' is a trick where the user propels the fingerboard into air and lands it, while maintaining two fingers on the board the entire time. Another popular trick is a 'kickturn,' which is maneuvering the fingerboard to pivot and change direction.

Many of such tricks can be performed in skate parks. Skate parks are destinations that commonly contain a variety of obstacles such as: railing; a halfpipe, a ramp that resembles a half of a pipe; a bowl, a ramp that resembles a bowl; and a funbox, a raised platform with extending ramps from its edges.

Obstacles in the parks challenge a user's expertise on the board. For example, one trick, called '50-50,' is frequently performed in skate parks because it requires the user to ollie up onto a rail, and then proceed to grind on the surface with the skateboard's trucks (the metal attachment to the wheels). Because fingerboards maneuver in the same way as skateboards, fingerboard skate parks mimic the obstacles found in regular skate parks, such as halfpipes.

A variety of skate parks for fingerboarding have been described in United States patent, such as U.S. Pat. No. 6,350,174 issued Feb. 26, 2002 to Halford entitled Rollup Half Pipe for a Miniature Toy Skateboard, the disclosure of which is incorporated herein by reference. Halford provided a rollup half pipe fingerboard skate park. Rails have also been incorporated, such as seen in U.S. Pat. No. 6,623,367 issued Sep. 23, 2003 to inventor Labelson entitled Amusement Round and Method For Constructing Same, the disclosure of which is incorporated herein by reference.

SUMMARY OF THE INVENTION

The present invention differs from the prior art in that the playing surface as well as the bottom can both be a hard shell construction, while at the same time also having high definition graphic presentation.

A skate park has a hard top shell formed with skate features drawn down from a top surface of the hardtop shell. The hard top shell has a thickness between 0.2 mm and 1 mm. The hard top shell has a hard top shell inside surface. The hard top shell is pervious to light. A sidewall is formed on a side of the hardtop shell. A paint layer is disposed on the hard top shell inside surface. The skate park may have at least one half pipe. A foil layer may be laminated to the underside of the hardtop shell. The skate park preferably includes at least one bowl recess, but may have two bowl recesses joined at a connecting ridge.

The plurality of skate features may include at least two bowl recesses joined at a connecting ridge and at least one half pipe. The skate park optionally includes a top layer of adhesive adhering to the hard top shell. A rigid foam core can be formed with a top profile and a bottom profile, so that the top profile matches and receives the top hard shell, and the top layer of adhesive adheres to a top surface of the foam core. A bottom layer of adhesive may adhere to a bottom surface of the rigid foam core; and a hard bottom shell can be formed with a bottom concave shell cavity. The bottom concave shell cavity could be formed to fit to the bottom profile. The hard bottom shell is pervious to light.

The hard top shell has a top printing means of a graphic film foil layer laminated to a graphic print layer. The graphic print layer is laminated to the hard top shell. The top printing means may include painting a lower surface of the hard top shell. A foil layer can be laminated to the paint layer of the hard top shell. The hard shell can be made from a formed sheet of PVC material.

The hard shell has a fingerboard recess, and wherein the skate park further comprises a fingerboard having a deck, a pair of trucks and four wheels, wherein the fingerboard fits into the fingerboard recess of the hard shell.

The skate park may have a first graphic slot sized to receive a first cardboard insert and a second graphic slot sized to receive a second cardboard insert. The half pipe extends across the width of the skate park forming a pair of side entrances of semicircular shape. The pair of side entrances are above grade, above the level of the table top. The hard shell has a fingerboard recess. The fingerboard has a deck, a pair of trucks and four wheels. The fingerboard fits into the fingerboard recess of the hard shell.

Figure 1:
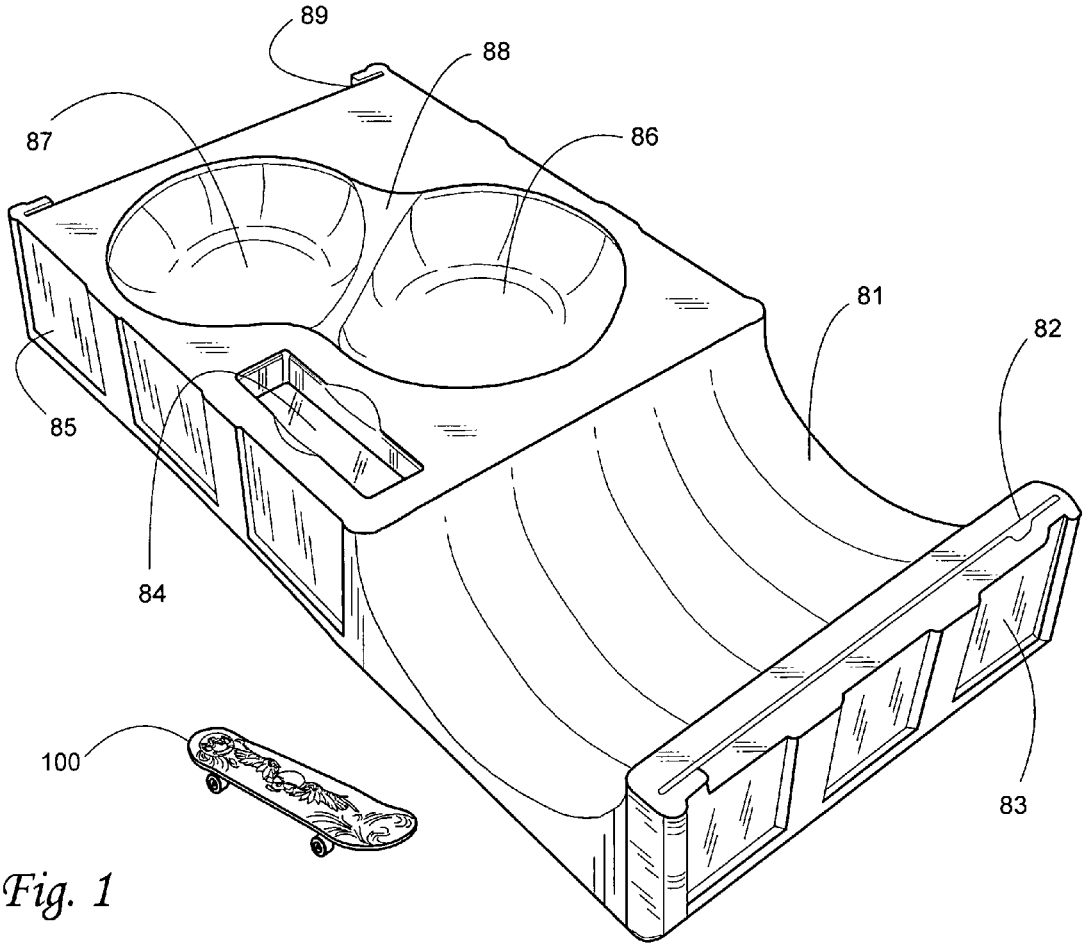
FIG. 1 is a top perspective view of the top shell of the skate park.
Figure 2:
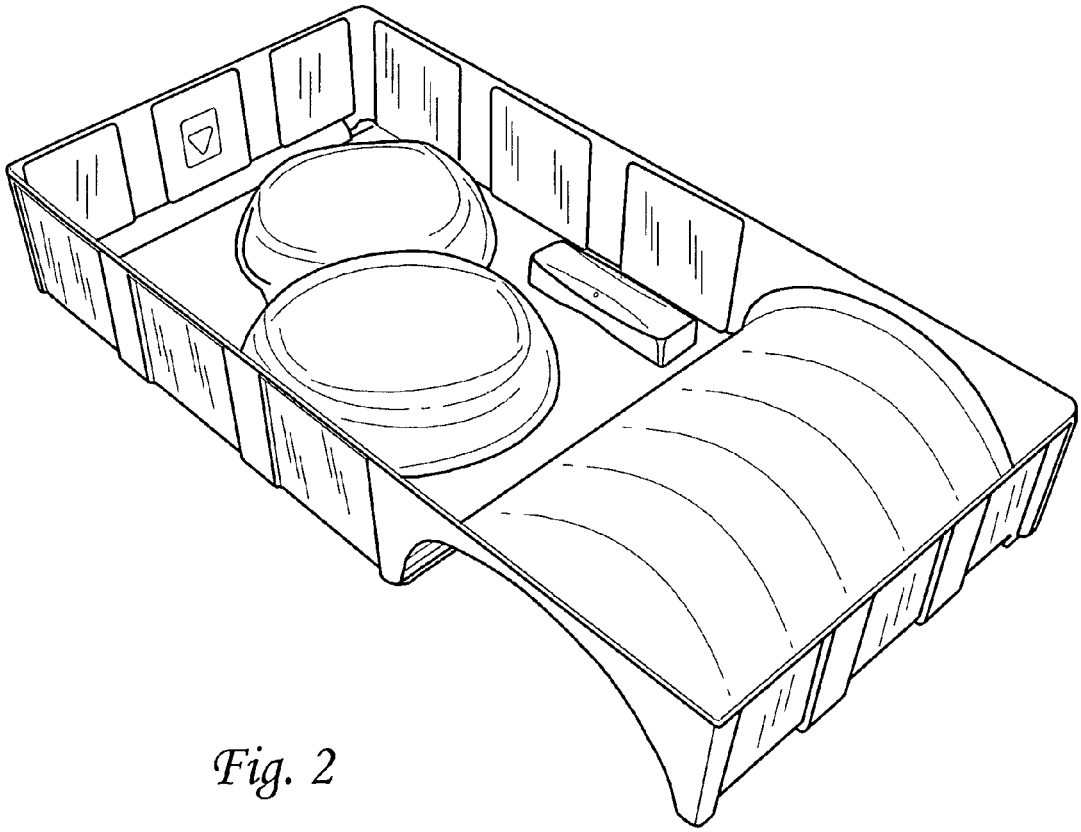
FIG. 2 is a bottom perspective view of the top shell of the skate park.

The following call out list of elements may be useful in referencing callout numbering in the drawings.

81 Half Pipe
82 First Graphic Slot
83 Terminal Structured Indent
84 Fingerboard Recess
85 Lateral Structured Indent
86 First Bowl Recess
87 Second Bowl Recess
88 Connecting Ridge
89 Second Graphic Slot
100 Fingerboard
11 Top Outside Graphic Layer
12 Top Hard Layer
14 Top Paint Layer
15 Top Shell
16 Top 1st Graphic Layer
17 Top 2nd Graphic Layer
18 Top Glue Layer
19 Top Substrate
21 Bottom Outside Graphic Layer
22 Bottom Hard Layer

24 Bottom Paint Layer
25 Bottom Shell
26 Bottom 2nd Graphic Layer
27 Bottom 1st Graphic Layer
28 Bottom Glue Layer
29 Bottom Substrate
41 Sheet Of PVC
42 Sheet Edge
43 Shell Cavity
45 Mold Cavity
46 Mold
47 Mold Top Face
48 Mold Top Edge

DETAILED DESCRIPTION OF THE PREFERRED EMBODIMENT

The present invention skate park is formed from a sheet of PVC molded to shape. The sheet of PVC has skinning features including a half pipe 81, a first bowl recess 86, a second bowl recess 87 and a connecting ridge 88 formed between the first bowl recess 86 and the second bowl recess 87. A plurality of edges are available for a fingerboard grind. A pair of long edges are formed at the top of the half pipe 81 allowing user interaction with the top of the half pipe. A user may also interact with the first bowl recess 86 and the second bowl recess 87. A number of tricks can be performed using the connecting ridge 88. For example, a user can take a fingerboard on the lip of the bowl and grind around to the ridge 88 and then transfer to second bowl recess 87. The connecting ridge 88 can be sized for grinding, and is slopes down so that it is lower than the plane of the top surface of the skate park. The half pipe extends the width of the skate park and presents a pair of almost at grade semicircular entrances for fingerboard entrance. The pair of entrances are accessible from a tabletop. The pair of bowl recesses are diagonally oriented and extend downward from an upper plane apex of the skate park.

The fingerboard 100 fits into fingerboard recess 84 allowing display and storage of the fingerboard while not in active use. The fingerboard recess 84 has a left and right finger indent for exposing a middle top portion of the fingerboard 100 to the user when the fingerboard 100 is lodged within the fingerboard recess 84. The fingerboard recess 84 is disposed in a top surface which is the apex of the skate park. The fingerboard 100 is a miniature skateboard having a miniature deck, miniature trucks and miniature wheels. The fingerboard 100 can be decorated with an imprinted graphic. The wheels on the fingerboard 100 can rotate when the user slides the fingerboard across a ride surface.

A plurality of lateral structured indents 85 extend along a left and right side of the skate park. The lateral structured indents 85 are preferably formed as three on a left side and three on a right side. The lateral structured indents 85 are rectangular shaped indentations creating vertical column protrusions between the lateral structured indents. The front and rear of the generally rectangular skate park also preferably include a plurality of terminal structured indents 83 formed at terminal portions of the generally rectangular skate park.

A first graphic slot 82 is adapted to receive in a releasable manner a first cardboard graphic for decoration. A second graphic slot 89 is also adapted to receive in a releasable manner, a second cardboard graphic for decoration. The cardboard graphics can be punched out from the product box by having the product box scored for punching out and inserting into the first graphic slot or the second graphic slot. The first graphic slot and a second graphic slot can be of same dimension to allow interchanging the first graphic cardboard piece and a second graphic cardboard piece.

The preferred and best mode embodiment of the skate park is made with a top hard layer 12 with a top paint layer 14 reverse printed to the top hard layer 12 to allow the imprinted graphic to appear from the top hard layer 12. A graphic layer is optionally thermally adhered to the imprinted graphic of the top paint layer 14. A foil film or preprinted graphic can be laminated to the top hard layer underneath the top hard layer in conjunction with or without the paint layer 14. The foil film can be made as a multiple layer film of a top first graphic layer 16 and a top second graphic layer 17 thermally laminated together.

Another option is to provide a top substrate 19 that is a polystyrene core for reinforcing the bottom of the hole portion of the top hard layer 12 forms the skate park. The polystyrene core can be molded to the same shape of the skate park so that the polystyrene core can be glued with a top glue layer 18 into the core for retention. The polystyrene core, namely the top substrate 19 may support and provide additional structural rigidity to the skate park without addition of heft.

Figure 3:
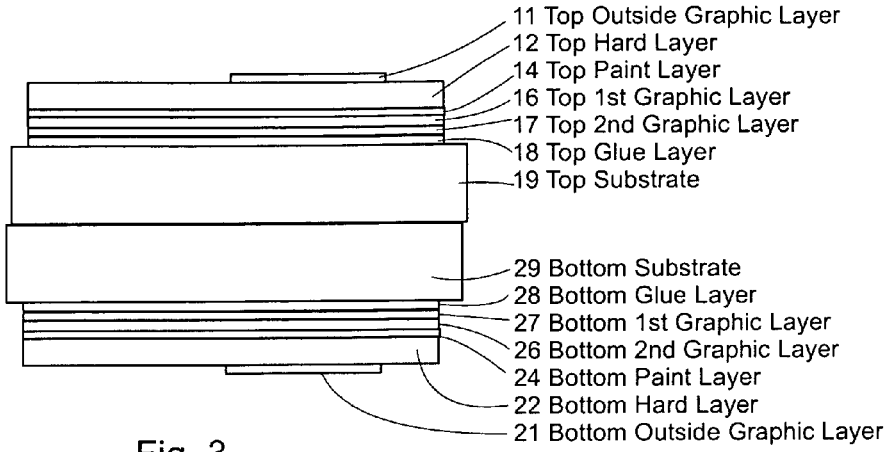
FIG. 3 is a cross-section diagram showing the laminate construction of the skate park.
Figure 4:
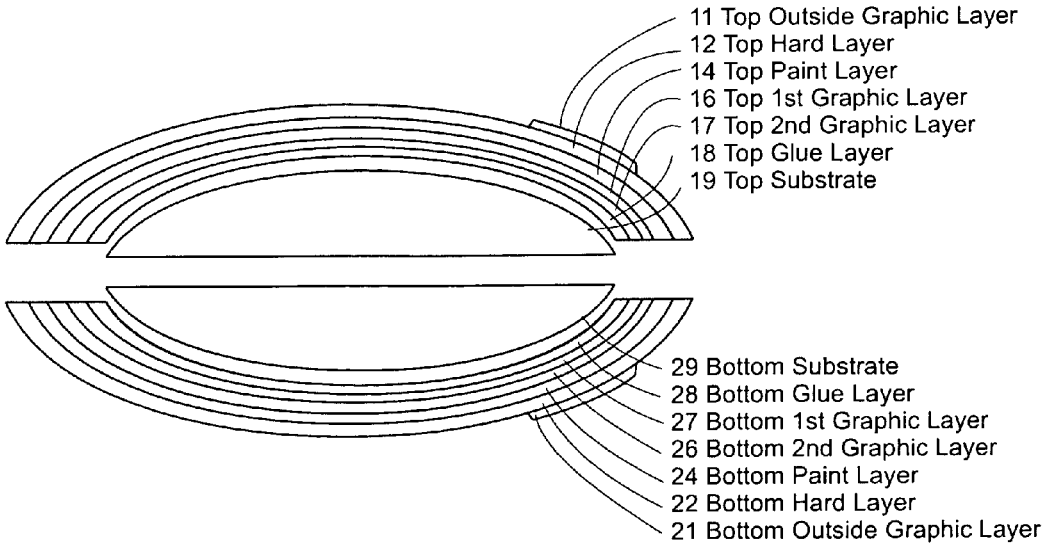
FIG. 4 is a cross-section diagram showing the laminate construction of the skate park.
Figure 5:
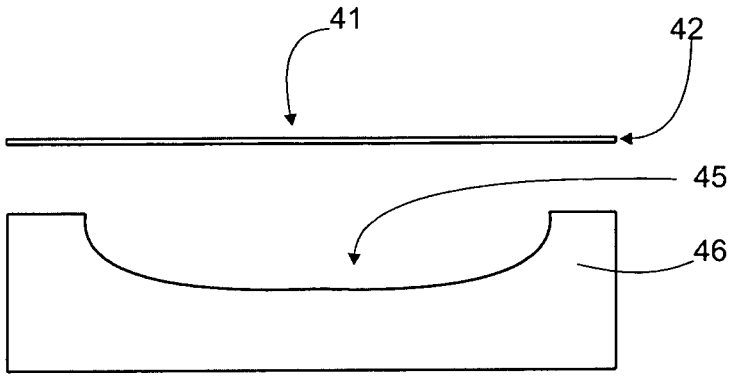
FIG. 5 is a diagram showing a construction step of the skate park.
Figure 6:
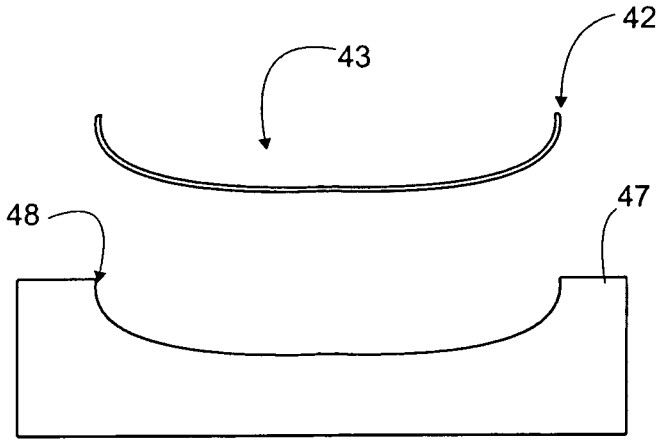
FIG. 6 is a diagram showing a construction step of the skate park.

It is possible to further include a bottom substrate 29 for decorating the bottom rectangular portion of the skate park. When the bottom is filled in, the bottom can be bare polystyrene foam, or can be decorated. The decorated bottom option includes a bottom substrate 29 that has a rectangular plank adhering to a bottom of the skate park. The bottom substrate 29 has a bottom glue layer 28. This alternate embodiment of the skate park can be made in three basic parts, the shell is formed in a layer construction according to FIG. 3 having a top cover that is preferably a hard shell of PVC which can be flexible. The bottom shell 25 is formed as a bottom cover which is also preferably a hard shell of PVC which can be flexible. The middle portion is optional can be a relatively rigid polyolefin foam such as polystyrene. The top cover is molded to a relatively hard shell shape, then the bottom cover is molded to a relatively hard shell shape, and the top cover is fitted over a polystyrene core. It is preferred to make a batch of top covers, then make a batch of bottom covers and then making a batch of polystyrene cores that match the top and bottom covers. The final step involves assembly using a spray or film glue to glue the top and bottom covers to the polystyrene core. The preferred glue is a spray on glue.

The top layer or top shell has a top hard layer 12 providing structural rigidity and structural strength to the top shell 15. The top hard layer 12 is preferably a sheet of transparent or translucent PVC that can be formed into a shell structure by vacuum forming in a hollow formation cavity. Depending upon the final shape, the top hard layer 12 can be made hard and rigid with as thin as 0.2 mm thickness of PVC, but can also be about 1 mm thick of PVC if necessary, such as if the skate park is relatively flat and the features are not drawn very deep. The best mode of thickness is approximately 0.5 mm in thickness.

A hollow formation cavity of a mold cavity 45 can receive a rectangular sheet of PVC 41 having a sheet edge 42 around the edge of the sheet. The mold cavity 45 is an opening which receives a heated piece of transparent PVC and vacuum forms the sheet into a shell such as a top shell 15 having a shell cavity 43. The shell cavity is concave. The top mold face 47 surrounds the mold cavity 45. An edge of the mold, namely the mold top edge 48 defines the extent of the suction power. Suction is formed in the mold cavity 45 by a plurality of openings on the surface of the mold cavity 45.

The sheet of PVC 41 is preferably first laminated to other sheets, and then trimmed with a trimming machine so that sheet edges 42 are formed. The sheet of PCV 41 is then heated until it is soft enough to be vacuum formed in a mold cavity 45 of a mold 46 so that the hard sheet is bent to form a shell cavity 43. The mold top face 47 is preferably flat so as to form a vacuum along eight mold top edge 48 for sucking in the hard sheet 41.

Before placing into the mold machine, the top hard layer 12 receives a top paint layer 14 on an underside of the top hard layer 12. Also before placing into the mold machine, the top hard layer 12 optionally receives a top first graphic layer 16 or a top second graphic layer. Printing means may include a means for adding graphics to the top shell which is the hardtop layer. For example, the top first graphic layer can be a foil such as a metallized plastic sheet that is laminated to the top paint layer 14, and the top second graphic layer can be a sheet of plastic film. Alternatively, the top first graphic layer can be a graphic film and at least some portions of the top paint layer 14 can be omitted so that the graphic film can be seen through the clear top hard layer 12. Alternatively, the top shell can be directly screenprinted with a foil as the first or second graphic layer under the screen printing. Foil means metallic colored film which may have thin metal deposit, not a thick sheet of metal like standard kitchen use aluminum foil.

The construction of the bottom layer is substantially similar to the construction of the top layer. The bottom layer has a bottom outside graphic layer 21 overlying a bottom hard layer 22, which in turn receives a bottom paint layer 24, and a bottom second graphic layer 26 and a bottom first graphic layer 27 which is secured by a bottom glue layer 28 to a bottom substrate 29. A top substrate 19 can be connected to the bottom substrate 29 especially if the substrate is made of similar material so that the core can be a multiple layer core.

The best mode for manufacturing the skate park is according to the following steps. The first step is to print the inside surface of the hard shell. The second step is to use laser printing for printing film which is heat laminated to the inside surface of the hard shell. The third step is to form the hard shell. The fourth step is to trim the hard shell edge in a trimmer. After the fourth step, the skate park is complete, but can be additionally upgraded by adding basic support including a top substrate and a bottom substrate.

The fifth step is to spray glue on the inside of the hard shell. The next step requires assemble the expanded polystyrene foam core with the hard shell top portion and hard shell bottom portion. The seventh step is to use heat and pressure for bonding all of the pieces together in a hot presser machine. The hot presser machine has a pair of heated top and bottom pads shaped to conform to the shape of the final product. Step eight is to trim the edge and seal the joining edge, preferably on an overlap channel. The top outside graphic layer 11 such as labels and other graphic decals can be applied in the final step, and afterwards packaging steps such as the hang and final inspection can be completed.

The best mode also includes the step of either painting the inside surface of the hard shell, or laminating printed film to the inside surface of the hard shell. Depending upon the design, it is generally more feasible to only paint the inside surface of the hard shell or only laminating printed film to the inside surface of the hard shell. The printed film can be printed on the inside surface of the printed film in reverse, or on the outside surface of the printed film in a positively printed non-inverted manner. The best mode is to print the film in a positively printed manner such that the print is on the top surface or outside of the printed film. The printing on the outside surface of the printed film would mean that the PVC and the printed portion may be touching.

The printing on the printed film can be opaque or a shiny lucent paint. The best mode for printing means is to print on the outside surface of a foil sheet which is then laminated to the PVC. It is also possible to use a bilayer printed film construction by having print on the inside surface of a clear sheet which then receives a foil sheet underneath the clear sheet. The bi-layer printed film construction can be first printed in a roll and laminated together in a roll of printed film, for later lamination to a PVC sheet. Another manner of printing would be to print on the inside surface of the PVC sheet, and laminate a foil underneath the PVC sheet.

When a base having a bottom substrate and bottom hard layer are used, the final product may receive grippy bottom feet for better tabletop grip. However, the best mode of the invention is to use only the top shell that is printed and optionally receiving a foil film underneath. When the top shell is in hollow configuration, it can be made stackable.

Therefore, while the presently preferred forms of the invention been shown and described, and several modifications thereof discussed, persons skilled in this art will readily appreciate that various additional changes and modifications may be made without departing from the spirit of the invention, as defined and differentiated by the following claims.

The invention claimed is:

1. A skate park comprising:

a. a hard top shell formed with a plurality of skate features drawn down from a top surface of the hardtop shell, wherein the hard top shell has a thickness between 0.2 mm and 1 mm, wherein the hard top shell has a hard top shell inside surface, wherein the hard top shell is pervious to light;

b. a sidewall formed on a side of the hardtop shell;

c. a paint layer disposed on the hard top shell inside surface, wherein the plurality of skate features includes at least two bowl recesses joined at a connecting ridge and at least one half pipe, wherein the hard shell has a fingerboard recess, and wherein the skate park further comprises a fingerboard having a deck, a pair of trucks and four wheels, wherein the fingerboard fits into the fingerboard recess of the hard shell.

2. The skate park of claim 1, wherein the hard shell has a first graphic slot sized to receive a first cardboard insert.

3. The skate park of claim 2, wherein the hard shell has a second graphic slot sized to receive a second cardboard insert.

4. A skate park:

a. a hard top shell formed with a plurality of skate features drawn down from a top surface of the hardtop shell, wherein the hard top shell has a thickness between 0.2 mm and 1 mm, wherein the hard top shell has a hard top shell inside surface, wherein the hard top shell is pervious to light;

b. a sidewall formed on a side of the hardtop shell;

c. a paint layer disposed on the hard top shell inside surface, wherein the plurality of skate features includes at least two bowl recesses joined at a connecting ridge and at least one half pipe, wherein the half pipe extends across the width of the skate park forming a pair of side entrances, wherein the pair of side entrances are above grade, wherein the hard shell has a fingerboard recess, and wherein the skate park further comprises a fingerboard having a deck, a pair of trucks and four wheels, wherein the fingerboard fits into the fingerboard recess of the hard shell.

5. The skate park of claim 4, wherein the hard shell has a first graphic slot sized to receive a first cardboard insert.

6. The skate park of claim 5, wherein the hard shell has a second graphic slot sized to receive a second cardboard insert.

* * * * *